US006362570B1

(12) United States Patent
Popov et al.

(10) Patent No.: US 6,362,570 B1
(45) Date of Patent: Mar. 26, 2002

(54) HIGH FREQUENCY FERRITE-FREE ELECTRODELESS FLOURESCENT LAMP WITH AXIALLY UNIFORM PLASMA

(75) Inventors: Oleg Popov, Needham; Robert Chandler, Lexington, both of MA (US)

(73) Assignee: Matsushita Electric Works Research and Development Laboratories, Inc., Woburn, MA (US)

( * ) Notice: Subject to any disclaimer, the term of this patent is extended or adjusted under 35 U.S.C. 154(b) by 0 days.

(21) Appl. No.: 09/420,673

(22) Filed: Oct. 19, 1999

(51) Int. Cl.[7] ..... H01J 17/16; H01J 61/30

(52) U.S. Cl. ..... 313/634; 313/490; 313/491; 313/493; 313/486; 313/485; 315/248; 315/70

(58) Field of Search ..... 313/491, 484, 313/485, 489, 490, 493, 634, 621, 607, 601; 315/248, 70, 85, 37; 336/226, 232

(56) References Cited

U.S. PATENT DOCUMENTS

| | | | | | |
|---|---|---|---|---|---|
| 3,500,118 | A | | 3/1970 | Anderson | 315/57 |
| 4,171,503 | A | * | 10/1979 | Kwon | 315/248 |
| 4,568,859 | A | | 2/1986 | Houkes et al. | 315/248 |
| 4,864,194 | A | | 9/1989 | Kobayashi et al. | 315/248 |
| 5,006,752 | A | | 4/1991 | Eggink et al. | 313/161 |
| 5,013,975 | A | | 5/1991 | Ukegawa et al. | 315/248 |
| 5,343,126 | A | | 8/1994 | Farral et al. | 315/248 |
| 5,572,083 | A | | 11/1996 | Antonis et al. | 313/46 |
| 5,723,947 | A | * | 3/1998 | Popov et al. | 313/634 |
| 5,747,945 | A | * | 5/1998 | Ukegawa et al. | 315/248 |
| 5,834,905 | A | | 9/1998 | Godyak et al. | 315/248 |
| 5,952,784 | A | * | 9/1999 | Witting | 313/634 |
| 5,962,968 | A | * | 10/1999 | van Os | 313/493 |
| 5,998,914 | A | * | 12/1999 | Kohne et al. | 313/161 |
| 6,081,070 | A | * | 6/2000 | Popov et al. | 313/490 |

FOREIGN PATENT DOCUMENTS

| | | | | |
|---|---|---|---|---|
| JP | 1031277 | * | 11/1998 | H01J/65/04 |

* cited by examiner

*Primary Examiner*—Ashok Patel
*Assistant Examiner*—Sikha Roy

(57) ABSTRACT

An electrodeless fluorescent lamp employs a glass envelope made from a single linear tube filled with inert gas and mercury vapor. Phosphor and protective coatings are disposed on the inner surface of the envelope walls. An induction coil of few turns made from silver coated copper or Litz wire is wrapped around the linear tube in its axial direction. The inductively-coupled axially uniform plasma is generated inside the linear tube. The discharge electric field and current form a closed-loop path inside a tube in its axial direction. The lamp is operated at frequencies from 100 KHz to 100 MHz and RF power from 10 W to 2000 W (dependent on lamp size and number of turns). The lamp power efficiency and efficacy are comparable to those in electrodeless lamps of closed-loop shape operated with and without ferrite core.

18 Claims, 6 Drawing Sheets

HIGH FREQUENCY FERRITE-FREE ELECTRODELESS FLOURESCENT LAMP WITH AXIALLY UNIFORM PLASMA

FIELD OF THE INVENTION

The present invention relates to electric lamps and, more specifically, to fluorescent electrodeless lamps operated at low and intermediate pressures without the use of ferrite at frequencies from 20 KHz to 200 MHz.

BACKGROUND OF THE INVENTION

Electrodeless fluorescent lamps utilizing an inductively coupled plasma were found to have high efficacy and lives that are longer than that of conventional fluorescent lamps employing hot cathodes.

The plasma that generates UV and visible light in a lamp is produced in a glass (or quartz) envelope filled with an inert gas such as argon or krypton and a metal vapor such as mercury, sodium or cadmium. To generate the plasma, an induction coil is positioned in close proximity to the lamp envelope.

The prior art teaches two types of electrodeless fluorescent lamps, ones with a ferrite core and ones without the ferrite core. The lamps operate at a frequency of 2.65 MHz that is allowed in many countries and employ an induction coil wrapped around a ferrite core (U.S. Pat. No. 4,568,859 by Houkes et al., U.S. Pat. No. 5,343,126 by Farral et al.). The use of the ferrite core is necessary to operate at low coil current and hence at low coil/core power losses.

However, the ferrite core gets hot during operation especially at high power, P>50 W. Therefore, cooling of the ferrite core is required to maintain its temperature below Curie point (U.S. Pat. No. 5,006,752 by Eggink et al., U.S. Pat. No. 5,572,083 by Antonis et al.) The longer a lamp bulb, the longer and heavier the ferrite core must be. This makes the ferrite core cooling structure very large, heavy, and cumbersome.

It is obvious that an electrodeless fluorescent lamp without ferrite core would be simpler in construction and less expensive.

In the prior art, U.S. Pat. No. 5,013,975 by Ukegawa et al., shows an induction coil wrapped around a tube. However, patentees did not disclose either the shape or size of the tube (eg. a sphere, cylinder, linear tube). The induction coil structure and its location were not specified either. U.S. Pat. No. 5,013,975 does not present the data about RF power, frequency range, lumen output, light spacial distribution as well as about lamp power efficiency and efficacy. The claims are supported with a few figures where the tube looks like a sphere wrapped with an induction coil near the sphere's diameter. This approach seems to provide reasonable plasma uniformity in bulbs of spherical shape or in bulbs of short length but it does not generate an axially uniform plasma in a long linear tube with the length much larger than diameter.

In U.S. patent application Ser. No. 09/256,137 by Popov and assigned to a common assignee, an electrodeless fluorescent lamp is disclosed which operated without a ferrite core at frequencies from 150 KHz to 15 MHz and RF power from 50 W to 220 W. The lamp envelope had so-called "closed-loop" shape that was employed in U.S. Pat. No. 3,500,118 by Anderson, and in U.S. Pat. No. 5,834,905 by Godyak et al. Both patents used ferrite cores.

The induction coil in the lamp described in U.S. patent application Ser. No. 09/256,137 has several windings (turns) that were positioned on the "atmospheric" side of the envelope tube. The coil was located either on the "inner" side of the closed-loop envelope or on the "outer" side of the envelope. The envelope tube length was much larger than the tube diameter. The lamp power efficiency, $P_{pl}/P_{lamp}$, and lamp efficacy, LPW, at f=260 KHz and RF power of 150 W were close to those of the lamp described in U.S. Pat. No. 5,834,905 that employed two ferrite cores and had the same tube shape and size.

Electrodeless lamps described in U.S. Pat. No. 5,834,905 and U.S. patent application Ser. No. 09/256,137 have an envelope of closed-loop ("tokamak") shape. Such a shape provides the continuity of the discharge current inside the envelope. That is, the current forms a closed-loop path along the tube envelope walls. To make such a loop, the U.S. Pat. No. 5,834,905 teaches that the envelope has to be made from two straight glass tubes that are sealed to each other with the two short tubes. The other implementation of the closed-loop approach was to bend a liner tube in a circle and to connect both tube ends thereby forming the closed-loop path for the gas and discharge current within the envelope.

In order to provide conditions for a closed-loop current of an inductive discharge excited in a single straight tube, Kobayashi et al. (U.S. Pat. No. 4,864,194) divided the tube volume in two parts by the introduction of the partition along the tube axis. The induction coil was wrapped along the tube walls in its axial direction. However, the division of the tube volume in two parts results in the reduction of the tube's effective radius that causes the increase of the discharge electric field and hence, power losses in the coil. Also, the introduction of the additional part (e.g. glass) in the lamp volume makes the lamp manufacturing process more complex and expensive.

We discovered a closed-loop path for the discharge current could be achieved inside of the linear single glass/quartz tube without the partition of the tube volume. The induction coil consists of a few windings (turns) wrapped along the tube walls in axial direction, normal to the diameter and parallel to the axis of the tube. The inductive discharge is generated along the tube walls with the current flowing along the walls in the tube axial direction thereby forming a closed-loop path inside the tube. As a result, the axially uniform plasma is generated along the whole length of the linear tube.

SUMMARY OF THE INVENTION

According to the present invention a novel approach is disclosed that results in an efficient ferrite-free electrodeless lamp that is operated at frequency from 100 KHz to 100 MHz. The lamp power efficiency and efficacy were found to be comparable to those of electrodeless closed-loop lamps described in U.S. Pat. No. 5,834,905 (Godyak et al.) and in our U.S. patent application Ser. No. 09/256,137.

The present invention comprises an electrodeless fluorescent lamp having a glass or quartz envelope made from linear single tube of any configuration, cross section and size. A filling of inert gas and vaporous metal such as mercury, cadmium, sodium is placed in the envelope. The metal vapor pressure is maintained below 1 Torr and the inert gas pressure is below 10 Torr. A protective coating is disposed on the inner surface of the envelope walls and a phosphor coating is disposed on the protective coating. An induction coil is disposed on the atmosphereic side of the envelope and formed from a plurality of windings (turns) that are parallel to each other and lie in the planes that are parallel to the tube axis. This results in the generation in the envelope of the axially uniform plasman and, hence, UV and visible radition.

An object of the present invention is to design an efficient ferrite-free electrodeless fluorescent lamp operated in a wide range of frequencies, from 100 KHz to 200 MHz and wide range of power, from 20 W to 2,000 W.

Another object of the present invention is to design an induction coil that consumes an insignificant amount of RF power in KHz and MHz range, so the efficiency of the lamp is the same or comparable to those of lamps described in U.S. Pat. No. 5,834,905 and in U.S. patent application Ser. No. 09/256,137.

Yet another object of the present invention is to locate the coil as to provide its efficient coupling with the lamp plasma.

Again another object of the present invention is to generate axially uniform plasma that generates axially uniform visible light.

A further object of the present invention is to design a lamp that is easy to manufacture and of low cost.

The many other objects, features and advantages of the present invention will become apparent to those skilled in the art upon reading the following specifications when taken in conjunction with the drawings and claims.

DESCRIPTION OF THE PREFERRED EMBODIMENT

Figure 1A:
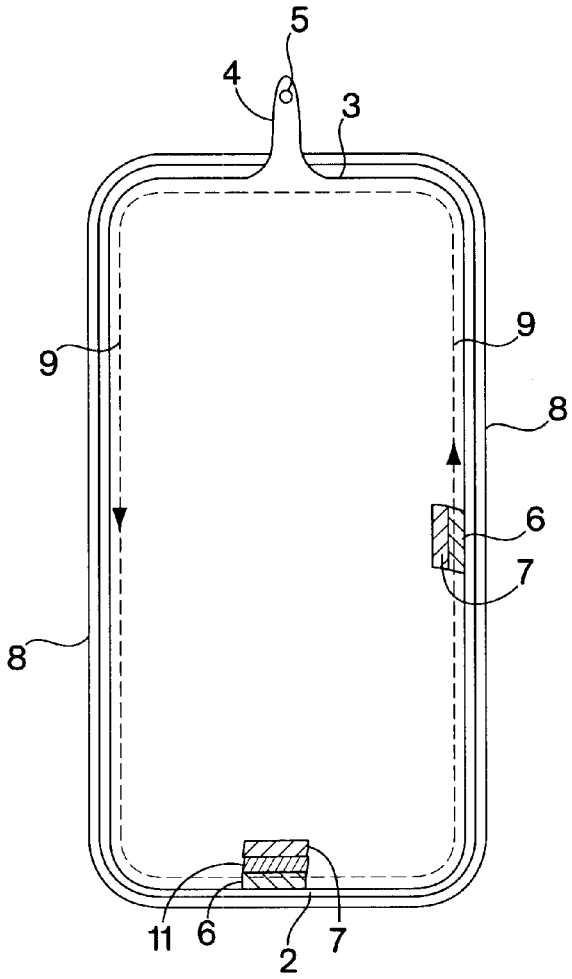
FIG. 1A is a side elevational view, partially in cross section of a first embodiment of the present invention
Figure 1B:
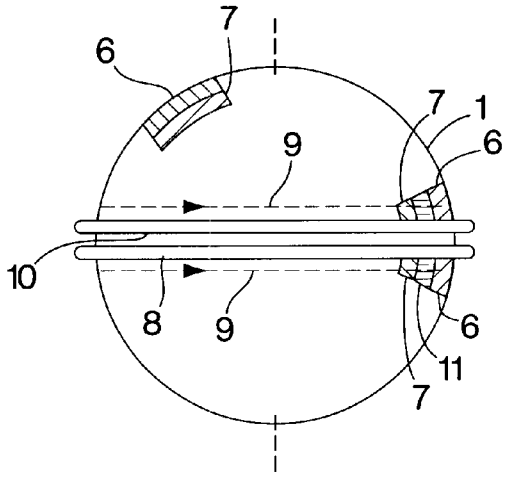
FIG. 1B is an end view, partially in cross section, of the embodiment shown in FIG. 1A.

Referring to FIG. 1, a lamp envelope 1 is a straight tube made from glass or quartz and sealed at the both ends, 2 and 3. The tube is filled with inert gas such as argon, krypton or the like. The vapor pressure of mercury is controlled by the temperature of the cold spot located at the exhausting tubulation 4. A small amount of mercury or an amalgam 5 is positioned at the cold spot. The inner surface of the envelope 1 is coated with a protective coating 6 and a phosphor coating 7.

An induction coil 8 is disposed on the outer surface of the envelope 1 along the envelope walls from the end 2 to the end 3 thereby providing a continuity of an RF discharge current in the envelope 1 along its walls thereby forming the closed-loop path 9. All turns of the coil are parallel to each other and lie in the planes that are parallel to the tube axis. Such an arrangement results in the generation in the envelope of an axially uniform plasma and UV an visible radiations. The area of the envelope surface 10 "covered" with the induction coil 8 depends on the tube diameter, the gauge of the coil wire and the number of windings. It varies from 1% to 10% of the total area of the envelope surface. The coil 8 blocks some of the light from the discharge plasma 9 through the envelope surface and is partially absorbed thereby reducing the total lamp light output and the lamp efficacy. To diminish the blocking effect of the coil 8 the inner surface 10 of the envelope 1 adjacent to the coil 8 is coated with the reflective coating 11 made from $Al_2O_3$ or other reflective material. The light is reflected from the reflective coating 11 and is eventually emitted through the envelope surface that is not blocked by the coil 8.

When operated in a "high" frequency range of 2–100 MHz, the induction coil 8 is made from copper wire coated with thin silver coating. The gauge number could be from #10 (for a large tube diameter of D≧10 cm) to #22 (for a small tube diameter of D≧2 cm). A thin white Teflon coating is used for electrical insulation and to reflect light from the coil 8. The number of turns (windings) depends on the driving frequency and varies from 1 turn (f=20–100 MHz) to 15 turns (f=0.4–1.0 MHz). The coil pitch can be from 0 to 20 mm. For the operation in a "low" frequency range of 0.02–2 MHz, the coil 8 is made from Litz wire having many strands of gauge from #38 to #42. The number of strands can be from 40 to 600. The coil pitch can be from 0 to 10 mm.

As was described in our U.S. Pat. No. 6,081,070, Litz wire has very low resistance, $R_c$, at low frequencies of 0.1–0.6 MHz that leads to high quality factor, $Q=\omega L_c/R_c$, at these low frequencies. Here $L_c$ is the coil inductance. In the preferred embodiment we used the induction coil 8 made from Litz wire having 435 strands each of gauge #40. The coil has 8 turns (windings) and high quality factor, Q, with its maximum of Q=400 at f=0.45 MHz. The coil pitch was zero to reduce the surface area 10 blocked by the coil. When operated at a frequency as low as 50–100 KHz, a double layer coil made from Litz wire was used. The maximum value of Q-factor of such a coil is at a frequency of 250 KHz. To reduce the surface area covered by the windings, a triple layered coil can also be used. Each layer has from 2 to 19 windings and the current in adjacent windings flows in the same direction.

Figure 2:
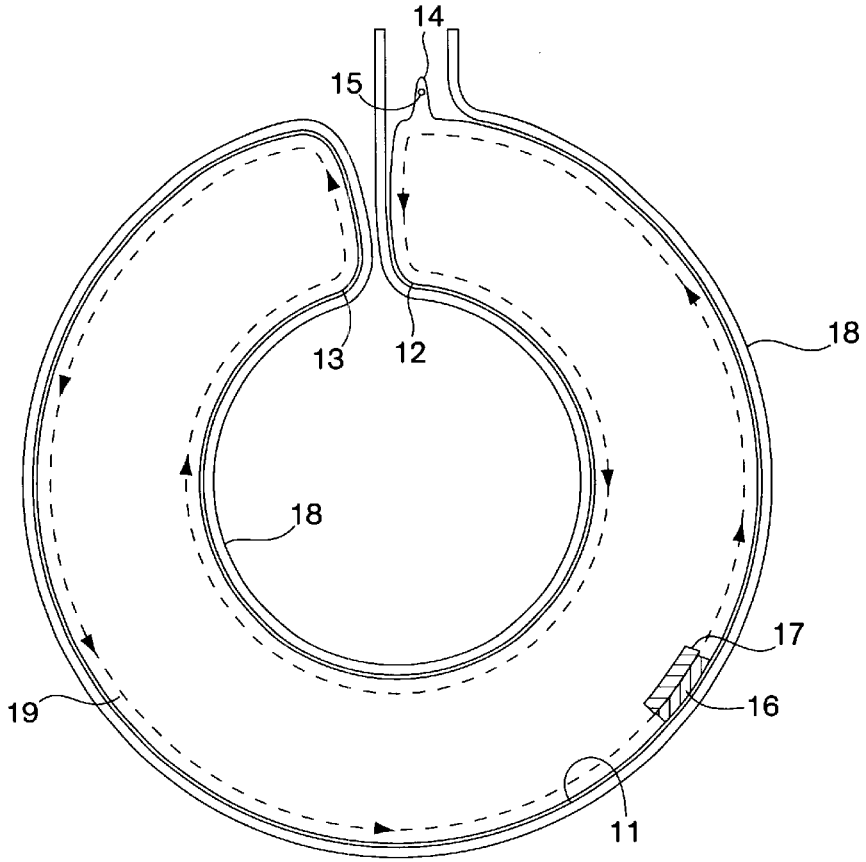
FIG. 2 is a schematic diagram of a second embodiment of the present invention.

The second embodiment of the present invention is glass/quartz tube with the same features as shown in FIG. 1 but bent in a circle as is shown in FIG. 2. The envelope 11 has two ends 12 and 13 that are separately sealed. The exhausting tubulation 14 has a conventional mercury dispenser or amalgam 15 disposed therein. The protective coating 16 and phosphor coating 17 are deposited on the inner walls of the envelope 11. The turns of the circular shaped coil are parallel to each other and to the circular-shaped tube axis in any tube cross section. Such an arrangement results in the generation of an axially uniform plasma and UV and visible radiations. The RF voltage is applied to an induction coil 18 to generate an inductive discharge with the closed-loop current having closed-loop path 19.

Figure 3:
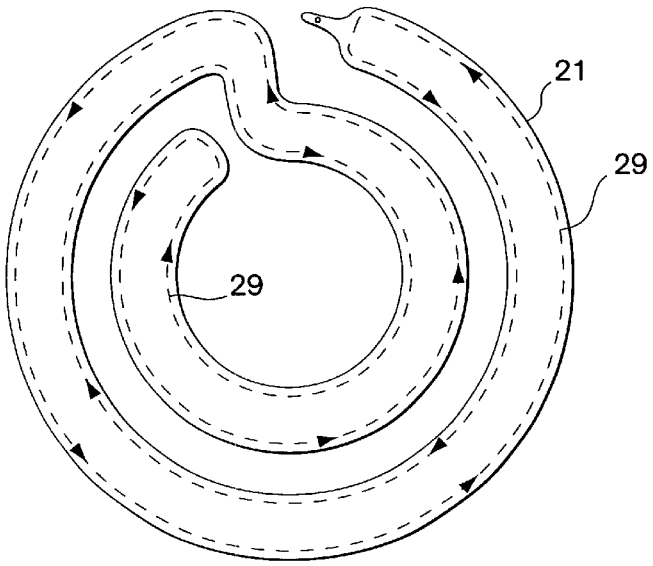
FIG. 3 is a schematic diagram of a third embodiment of the present invention.

The third embodiment of the present invention is shown in FIG. 3. The envelope 21 is made from a glass tube bent in a spiral shape. The current of the induction plasma generated in the envelope 21 has a closed-loop path 29.

Figure 4:
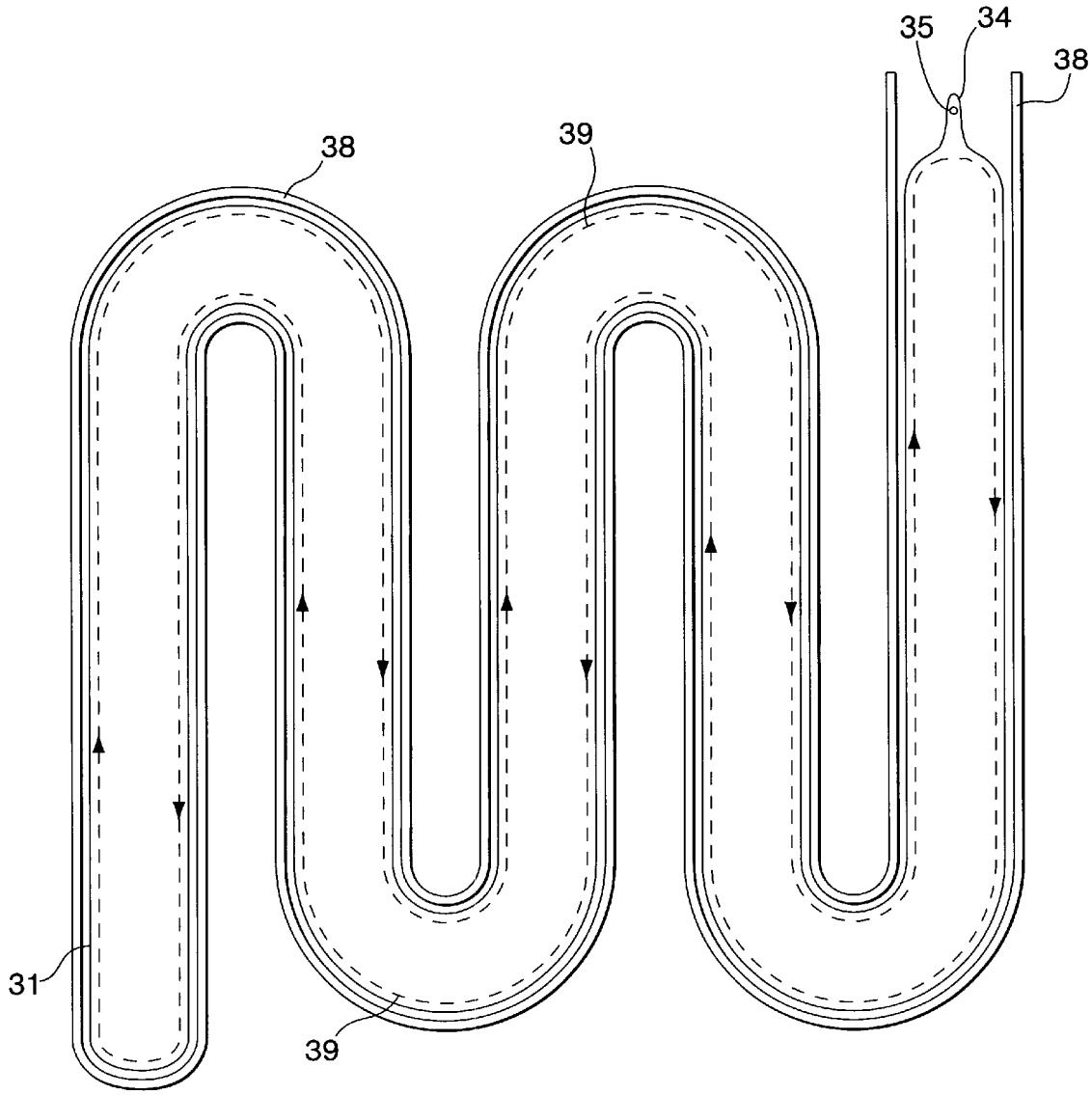
FIG. 4 is a schematic diagram of a fourth embodiment of the present invention.

The fourth embodiment of the present invention is shown in FIG. 4. The envelope 31 is made from a glass tube of a cycloid shape. The tubulation 34 contains a mercury dispenser or amalgam 35 that controls mercury vapor pressure in the envelope. The RF voltage applied to the induction coil 38 generates in the envelope 31 the inductive discharge that has a current with a closed-loop path 39.

We tested lamps designed and manufactured in accordance with the first embodiment of the present invention shown in FIG. 1. The lamp diameters were 50 mm and 75 mm and the length was 300 mm. In operation, the RF voltage is applied to the lamp coil from the RF power source via a conventional matching network. The latter consists of capacitors (thin film or ceramic) connected in series and in parallel. The capacitive discharge is ignited in the lamp envelope 1 at relatively low coil voltage, $V_{cap}$=150–200 V.

The lamp starts (the appearance of a bright inductively coupled plasma) when the coil voltage reaches the certain value, $V_{st}$, that is determined by the plasma starting azimuthal electric field, $E_{st}$, by the discharge path length, $L_{path}$, by the coil number of turns (windings), $N_{coil}$, and by the coupling coefficient between the coil and the plasma, k:

$$V_{st}=V_{pl}N_{coil}/(k)^{1/2}=E_{st}L_{path}N_{coil}/(k)^{1/2}$$

For instance, the lamp shown in FIG. 1 (the embodiment 1 of the present invention) with four windings (turns) has starting voltage of 860 V and starting current, $I_{st}$, of 4.5 A at argon pressure of 0.1 Torr. The decrease of the number of turns causes the decrease of $V_{st}$ and the increase of $I_{st}$.

The appearance of the bright axially uniform inductively coupled plasma is accompanied with the drop of the coil voltage and current. At RF power of 100 W the lamp with two turns and RF frequency of 8.5 MHz has the maintaining coil voltage, $V_m$=220 V, and maintaining coil current, $I_m$=3.8 A. Coil power losses, $P_{loss}$, and the lamp power efficiency, $P_{pl}/P_{lamp}$, as functions of lamp RF power, $P_{lamp}$, are plotted in FIG. 5 for the RF frequency of 7.5 MHz. The coil was made from wire of gauge #14 with two turns (windings).

Figure 5:
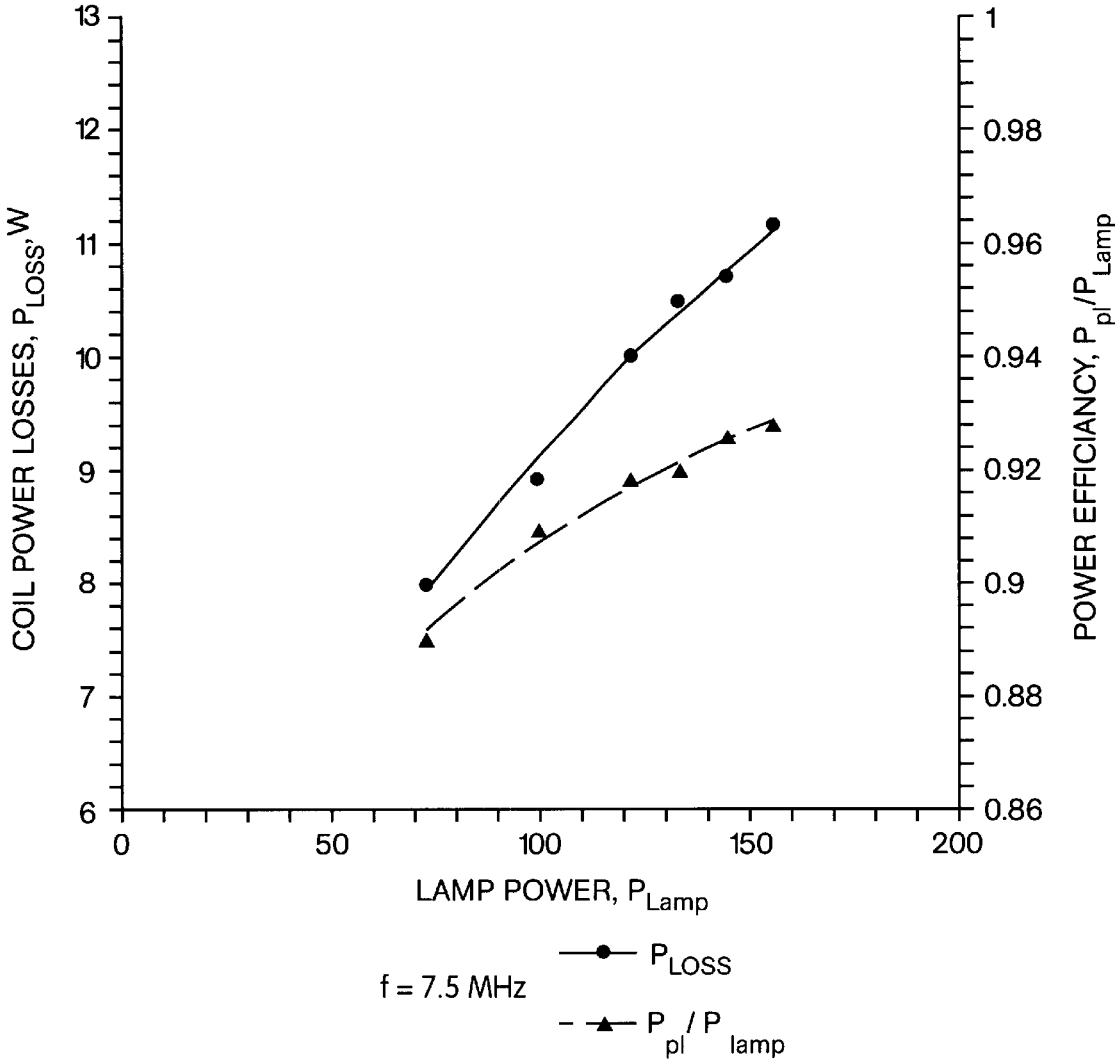
FIG. 5 is the graph showing the coil power losses, $P_{loss}$, and the lamp power efficiency, $P_{pl}/P_{lamp}$, as functions of the total power consumed by the lamp, $P_{lamp}$, for a frequency, f=7.5 MHz. The lamp is as shown in FIG. 1 (the first embodiment). The bulb diameter is 50 mm, the bulb length is 300 mm. The coil is made from copper wire, gauge #14, coated with the silver. The coil has two turns with an inductance, $L_c$=2.3 $\mu$H.
Figure 6:
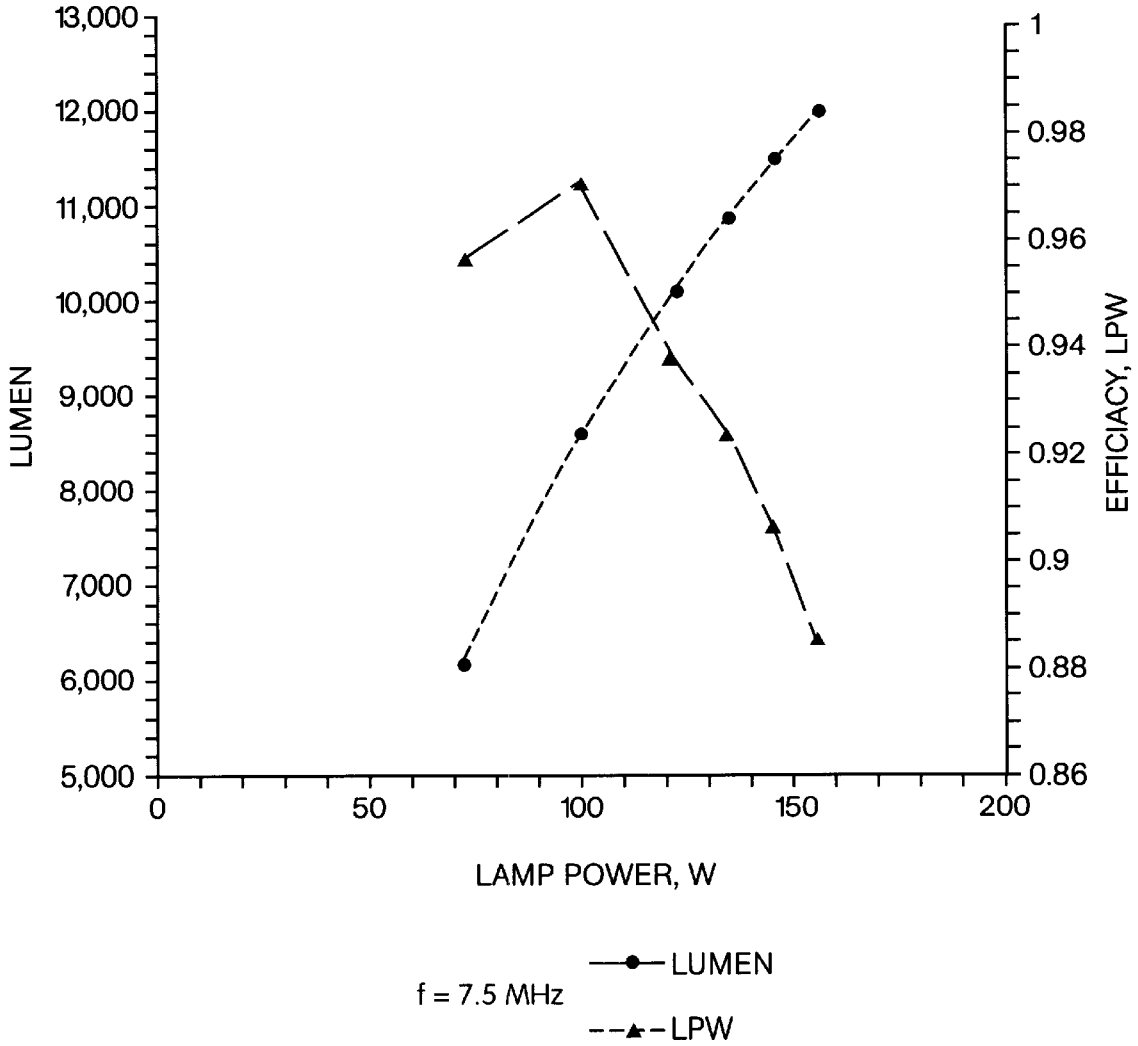
FIG. 6 is the graph showing the lamp total light output (Lm) and the lamp efficacy (LPW) as functions of the lamp power, $P_{lamp}$, for the driving frequency, f=7.5 MHz. The lamp is as shown in FIG. 1 and described in FIG. 5.
Figure 7:
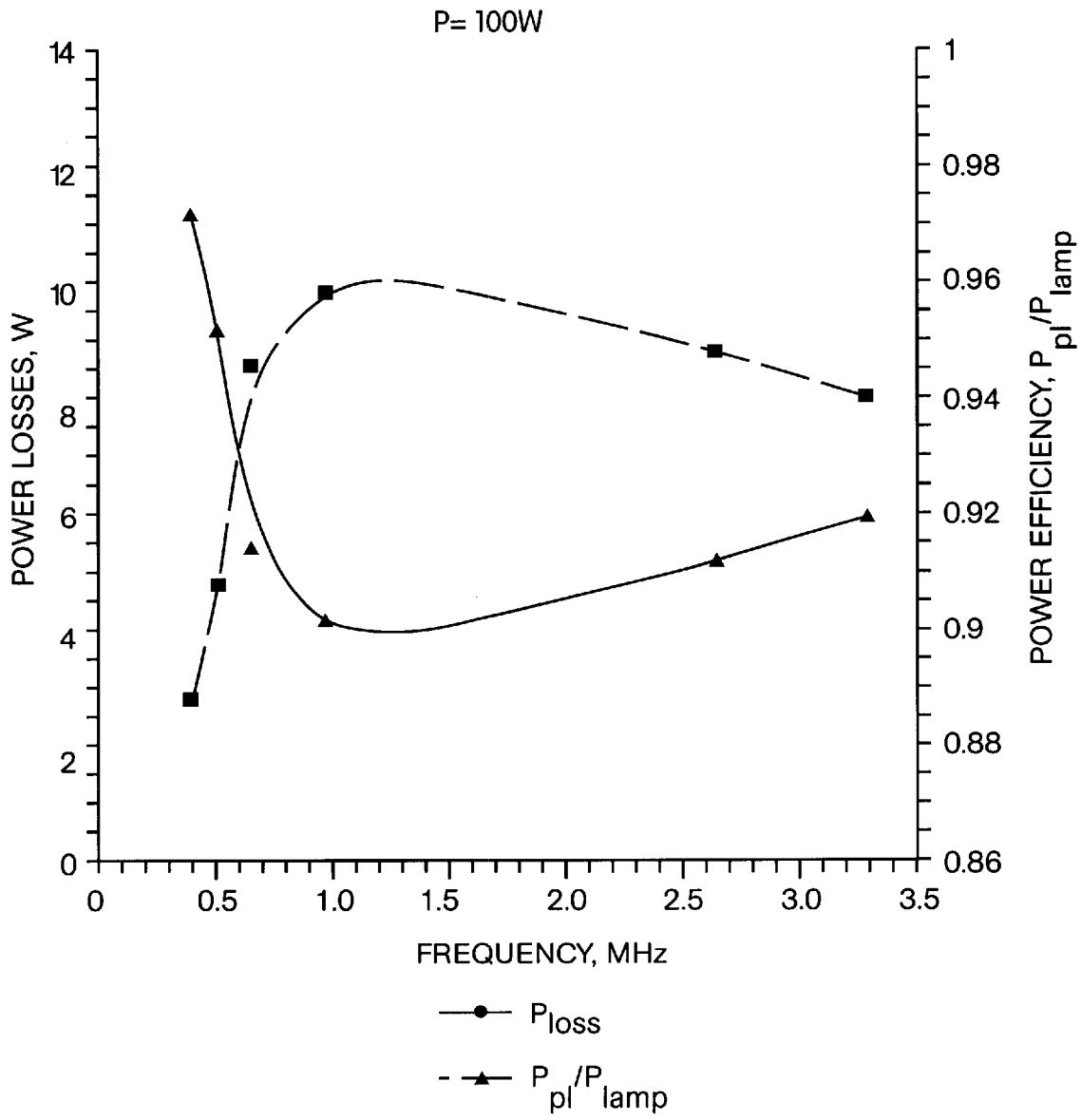
FIG. 7 is the graph showing the coil power losses and the lamp power efficiency (for the embodiment shown in FIG. 1) as functions of the driving frequency. The lamp power is 100 W. The coil is made from Litz wire having 435 strands of gauge #40. The coil has 8 windings (turns) with the inductance, $L_c$=19.2 $\mu$H.
Figure 6:
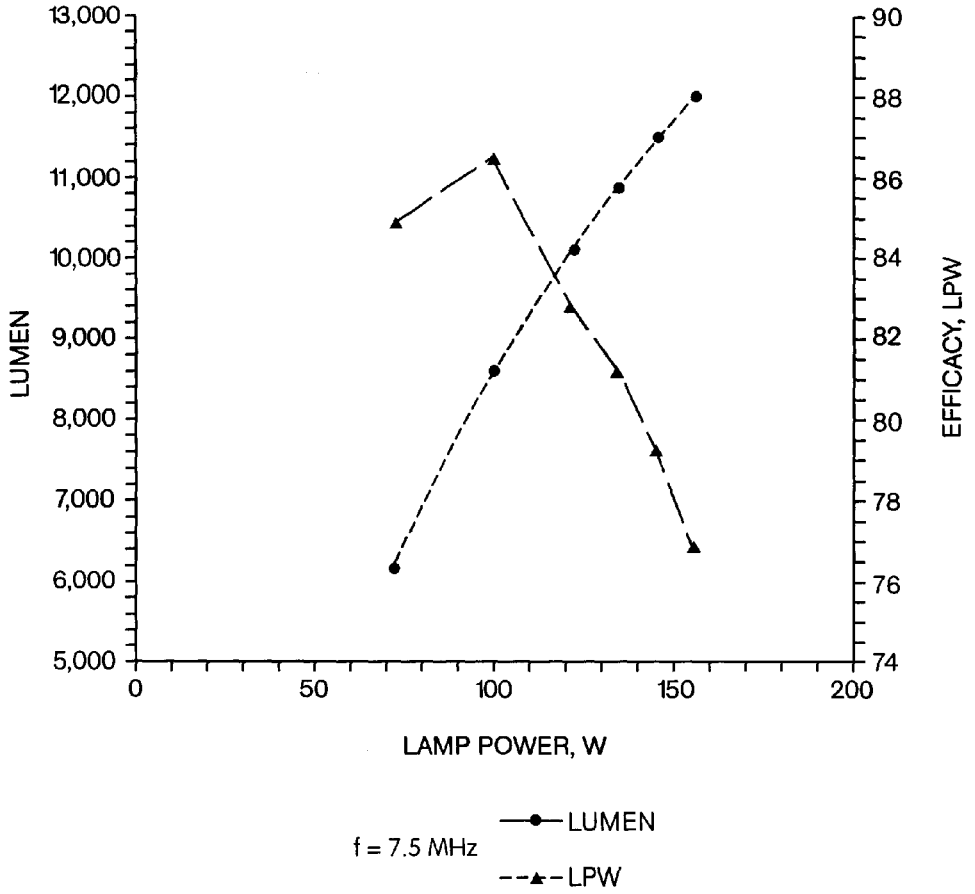

It is seen from FIG. 5 that within the RF power range of $P_{lamp}$=70–160 W, coil power losses, $P_{loss}$, increase with $P_{lamp}$ from 8 W at $P_{lamp}$=72 W, to 11 W at $P_{lamp}$=160 W. The lamp power efficiency, $P_{pl}/P_{lamp}$) also increases with $P_{lamp}$ from 0.85 at $P_{lamp}$=72 W to 0.93 at $P_{lamp}$=160 W. The further increase of $P_{lamp}$ leads to the saturation in the dependence of lamp power efficiency from $P_{lamp}$. The high lamp power efficiency at $P_{lamp}$>100 W (>0.91) results in high lamp efficacy. The lamp total light output and efficacy as functions of lamp power, $P_{lamp}$, are shown in FIG. 6 for the same lamp and the same frequency of 7.5 MHz. It is seen that while light output increases monotonically with $P_{lamp}$, lamp efficacy has a maximum of 86 LPW around $P_{lamp}$=100 W. The coil power losses, $P_{loss}$., and lamp power efficiency, $P_{pl}/P_{lamp}$, in a lamp operated at low frequencies of 400–3300 KHz and lamp power of 100 W are shown in FIG. 7 as functions of the driven frequency. The induction coil was made from Litz wire (450 strands each of gauge #40) and had eight turns (windings).

It is seen from FIG. 7 that $P_{loss}$ has the minimum of 4 W at RF frequencies of 1–1.5 MHz. At higher frequencies $P_{loss}$ increases again due to the steep increase of the Litz wire resistance with frequency though the coil current decreases as f increases. As a result, the lamp power efficiency, $P_{pl}/P_{lamp}$, has the maximum of 0.96 at frequencies of 1–1.5 MHz. But even at frequencies of 400–500 KHz the lamp power efficiency is still high, ≈0.9, that is comparable to that in a lamp utilizing two coils (windings) made from silver coated copper wire of #14 gauge (see FIG. 6).

It is apparent that modifications and changes can be made within the spirit and scope of the present invention, but it is our intention, however, to be limited only by the scope of the appended claims.

As our invention, we claim:

1. An electrodeless fluorescent lamp comprising:

a glass lamp envelope formed of a tube having two sealed ends;

a filling of inert gas and at least one vaporous metal selected from the group consisting of mercury, cadmium, sodium, the vapor pressure of said metal being below 10 torr during operation;

a protective coating disposed on the inner surface of said envelope and a phosphor coating disposed on said protective coating;

an inductive coil formed of a plurality of turns disposed on the atmospheric side of said tube along the wall of said tube in the axial direction, said turns being parallel to each other and disposed in planes, said planes being parallel to the axis of said tube at any cross section of said tube thereby generating a closed-loop axially uniform plasma in said tube;

a radio-frequency (RF) power source coupled to said coil to ignite and maintain RF discharge in said envelope to generate a plasma.

2. The electrodeless fluorescent lamp as defined in claim 1 further including a reflective coating disposed on the inner surface of said envelope adjacent to said coil.

3. An electrodeless fluorescent lamp as defined in claim 1 wherein said envelope is a straight tube sealed at both ends and having the same diameter in any cross section.

4. An electrodeless fluorescent lamp as defined in claim 1 wherein said envelope is made from a single tube having two sealed ends and being bent in a circle, said tube having substantially the same diameter at any cross section.

5. An electrodeless fluorescent lamp as defined in claim 1 wherein said envelope is made from a single tube having a spiral shape and two sealed ends, said tube having the same diameter at any cross section.

6. An electrodeless fluorescent lamp as defined in claim 1 wherein said envelope is made from a single tube having a cycloid shape and two sealed ends, said tube has the same diameter at any cross section.

7. An electrodeless fluorescent lamp as defined in claim 1 wherein said induction coil is made from copper wire of 10 to 26 gauge.

8. An electrodeless fluorescent lamp as defined in claim 7 wherein said copper wire is coated with silver.

9. An electrodeless fluorescent lamp as defined in claim 8 wherein said wire has Teflon insulation.

10. An electrodeless fluorescent lamp as defined in claim 1 wherein said coil is made from Litz wire and said Litz wire is formed of copper strands of 36 to 44 gauge.

11. An electrodeless fluorescent lamp as defined in claim 10 wherein said Litz wire has 50–600 strands.

12. An electrodeless fluorescent lamp as defined in claim 11 wherein said Litz wire is painted white.

13. An electrodeless fluorescent lamp as defined in claim 1 wherein said coil has from 1 to 20 turns.

14. An electrodeless fluorescent lamp as defined in claim 1 wherein the pitch between turns of said coil is from about 0 to 20 mm.

15. An electrodeless fluorescent lamp as defined in claim 1 wherein said coil has two layers of turns and said coil is wound so currents in adjacent turns of said layers flow in the same direction.

16. An electrodeless fluorescent lamp as defined in claim 1 wherein said coil has three layers of turns and said coil is wound so currents in adjacent turns of said layers flow in the same direction.

17. An electrodeless fluorescent lamp as defined in claim 1 wherein said RF power is at a frequency from 20 KHz to 200 MHz.

18. An electrodeless fluorescent lamp as defined in claim 1 wherein said RF power can be from 10 W to 3000 W.

* * * * *

UNITED STATES PATENT AND TRADEMARK OFFICE

CERTIFICATE OF CORRECTION

PATENT NO. : 6,362,570 B1
DATED : March 26, 2002
INVENTOR(S) : Popov et al.

It is certified that error appears in the above-identified patent and that said Letters Patent is hereby corrected as shown below:

Drawings,

Delete drawing Sheet 5 of 6, and substitute therefore the drawing Sheet consisting of Fig. 6 as shown on the attached page.

Signed and Sealed this

Thirteenth Day of August, 2002

*Attest:*

*Attesting Officer*

JAMES E. ROGAN
*Director of the United States Patent and Trademark Office*